US005754431A

United States Patent [19]

Kotaki

[11] Patent Number: 5,754,431

[45] Date of Patent: May 19, 1998

[54] METHOD AND APPARATUS FOR DESIGNING A TUBULAR KNITTED FABRIC USING A FLAT KNITTING MACHINE

[75] Inventor: Kenji Kotaki, Kishiwada, Japan

[73] Assignee: Shima Seiki Manufacturing, Ltd., Wakayama, Japan

[21] Appl. No.: 713,258

[22] Filed: Sep. 12, 1996

[30] Foreign Application Priority Data

Sep. 18, 1995 [JP] Japan ..... 7-264993
Sep. 18, 1995 [JP] Japan ..... 7-264994

[51] Int. Cl.[6] ..... G06F 19/00; G06G 7/64; G06G 7/66

[52] U.S. Cl. ..... 364/468.03; 364/470.02; 364/470.03; 364/470.07; 364/470.12

[58] Field of Search ..... 364/468.03, 470.02, 364/470.03, 470.07, 470.12, 470.13, 192, 191; 66/232, 75.2, 237, 64, 60, 62, 69, 30

[56] References Cited

U.S. PATENT DOCUMENTS

| | | | |
|---|---|---|---|
| 3,656,323 | 4/1972 | Brown | 66/177 |
| 4,346,366 | 8/1982 | Kajiura et al. | 340/146.3 |
| 4,479,368 | 10/1984 | Gloeckler | 66/75.2 |
| 4,527,402 | 7/1985 | Swallow et al. | 66/55 |
| 4,608,642 | 8/1986 | Shima | 364/470 |
| 4,633,793 | 1/1987 | Engle | 112/121.11 |
| 4,768,357 | 9/1988 | Ohtake | 66/75.2 |
| 4,856,104 | 8/1989 | Stoll et al. | 364/470 |
| 5,020,340 | 6/1991 | Gariboldi et al. | 66/125 |
| 5,271,249 | 12/1993 | Mitsumoto et al. | 66/60 |
| 5,319,565 | 6/1994 | Hausammann et al. | 364/470 |
| 5,379,615 | 1/1995 | Shima | 66/176 |
| 5,388,050 | 2/1995 | Inoue et al. | 364/470 |
| 5,557,527 | 9/1996 | Kokati et al. | 364/470.02 |

*Primary Examiner*—Reba I. Elmore
*Assistant Examiner*—Ramesh Patel
*Attorney, Agent, or Firm*—Nikaido, Marmelstein, Murray & Oram LLP

[57] ABSTRACT

The design data of a front body and front portions of both sleeves are stored, with being separated into three kinds of data of profiles, the kinds of stitches, and patterns, such as intarsia and jacquard. Similarly, a back body and back portions of both sleeves are stored, with being separated into three kinds of design data of profiles, the kinds of stitches, and patterns, such as intarsia and jacquard. The stored design data may be displayed in a singular form, such as the front body only, and in a synthesized form, such as the front body and the front portions of the sleeves. Similarly, the front body and the back body may be synthetically displayed.

17 Claims, 9 Drawing Sheets

15

FIG. 6
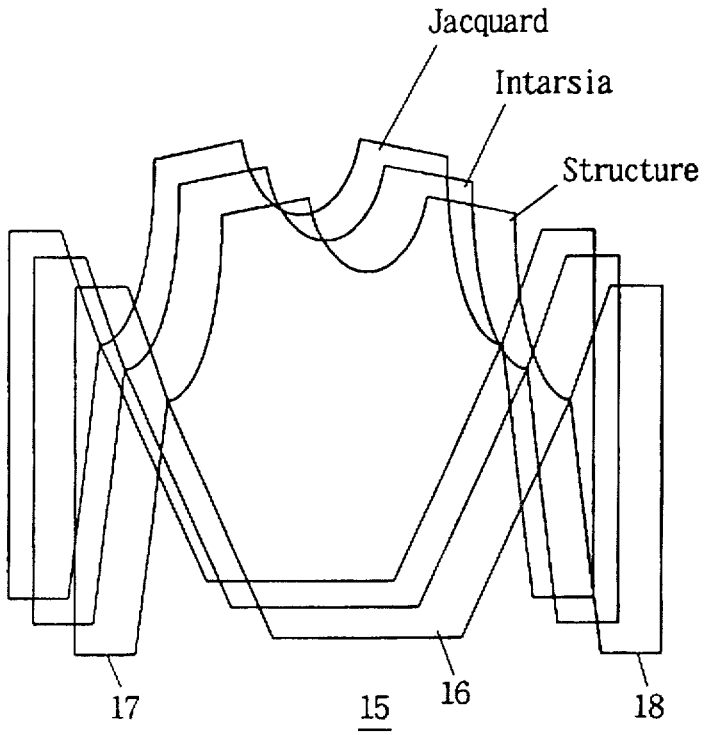
FIG. 7 (A)
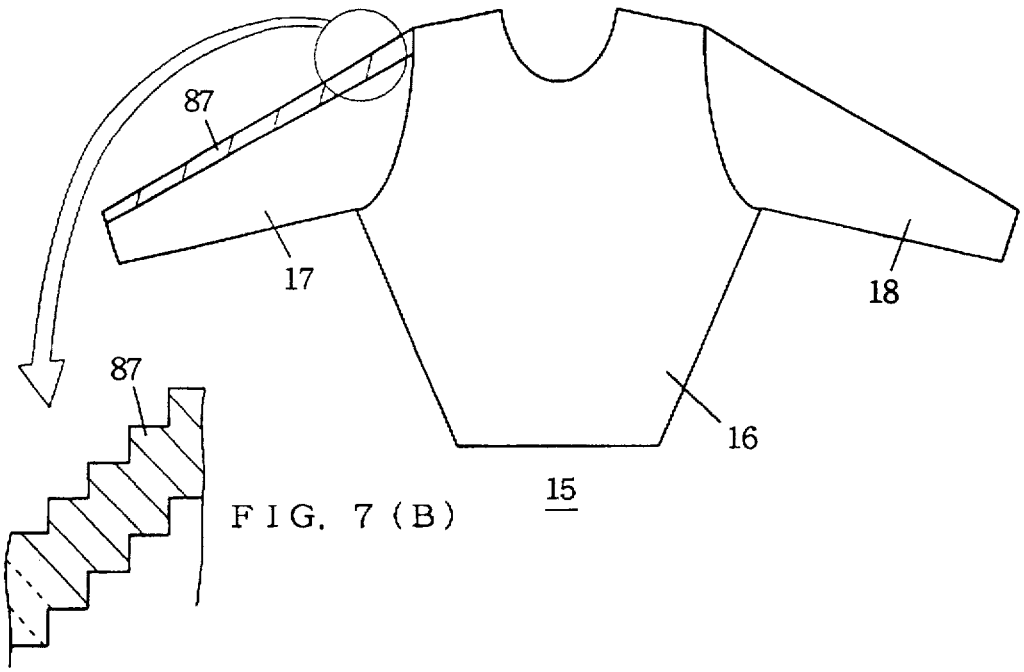
FIG. 7 (B)

FIG. 10(A)
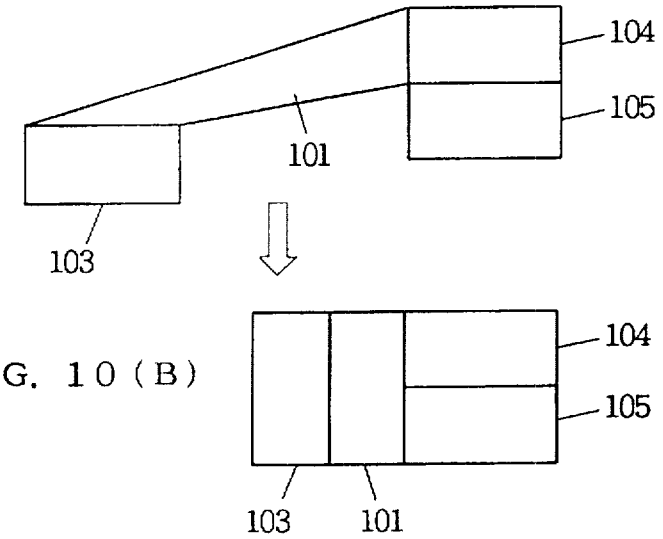
FIG. 10(B)
FIG. 11
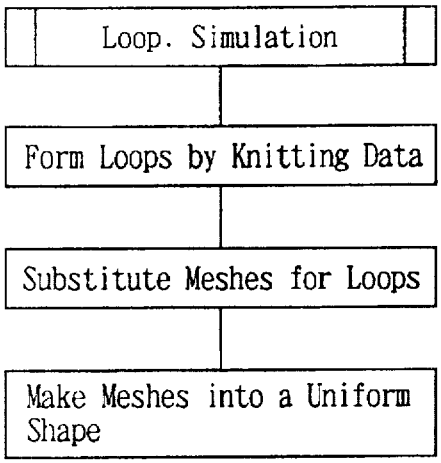

METHOD AND APPARATUS FOR DESIGNING A TUBULAR KNITTED FABRIC USING A FLAT KNITTING MACHINE

FIELD OF THE INVENTION

The present invention relates to a method of designing tubular knitted fabrics, such as seamless knitted garments and integral knitted garments, and an apparatus therefor, and in particular, a method of designing for knitting these knitted fabrics on a flat knitting machine and an apparatus therefor. The invention also relates to the simulation of the design data thus designed and in particular, the simulation of sleeves, collars, pockets, etc.

PRIOR ART

A variety of proposals have been made to seamless knitted garments such as pullovers and one piece dresses, or to knit one garment virtually without any seams. Similarly, knitting a garment singularly with each element thereof being knitted in its desired form or integral knitting has been proposed. These knitting techniques can be applied not only to knit clothes but also to knit a variety of tubular fabrics. With regard to this point, the improvement in the performance of knitting machines and modifications of knitting techniques have been remarkable. For example, a knitting technique for knitting seamless garments by means of a flat knitting machine with two needle beds has been developed (Japanese Provisional Patent SHO 60-194154) , and flat knitting machines with four needle beds, etc. have been developed for seamlessly knitted garments (e.g. Japanese Patent HEI 1-51575 and Japanese Provisional Patent HEI 4-370252). Design environment for tubular knitted fabrics, however, has not been considered at all, and no proposals have been made with regard to how tubular knitted fabrics may be designed efficiently.

The present assignee has proposed a designing method and a designing apparatus for shaped knit (Japanese Provisional Patent HEI 7-119004, corresponding to European Patent 640707-A1) . In this method, each stitch, or loop is displayed on a monitor with an aspect ratio proportional to the actual horizontal and vertical sizes of the stitch. In this method, the display is made to correspond to the aspect ratio of the stitch. Hence the displayed image is similar to the actual knitted fabric; thus a realistic representation can be made. The design data of the knitted fabric is divided into the structure data comprising the profile data (pattern data) of the knitted fabric and the kind of stitch, and other information of pattern such as intarsia and jacquard, and the respective sets of information are stored and displayed independently of each other. These sets of information can be displayed synthetically, and the patterns such as intarsia and jacquard, the structural patterns and the profile of the knitted fabric may be contrasted to each other. With these arrangements, the profile of the knitted fabric, rib structures in the bottom, collar, etc., and structural patterns such as cable pattern may be designed in the frame of structural information. With regard to the design of intarsia, jacquard, etc., they can be designed independently of the structural information. Thus, the design environment for knitted fabrics of shaped knit has been established. However, the design environment of tubular knitted fabrics has not been considered.

Design of tubular knitted fabrics poses the following problems. First, the front knitted fabric and the rear knitted fabric of the fabric must be designed separately. However, it is difficult to design these two fabrics simultaneously, and the two designs of the front and rear knitted fabrics must be correlated with each other. For example, design must be made in such a way that whenever one course of the front body is knitted, one course of the back body will be knitted, and thus tubular knitting is made.

Let us assume, for example, the front knitted fabric is to be knitted on a front bed of a knitting machine, and the rear knitted fabric on a rear bed. With regard to the design of the rear knitted fabric, (hereinafter rear fabric), from the standpoint of the designer, it is desirable that he or she can design the rear fabric while seeing the tubular knitted fabric from behind (the rear). In the practical knitting, however, the rear fabric is knitted according to the knitting data based on seeing the fabric front ways (the front side of the knitted fabric). It, therefore, is necessary to convert the knitting data in which the design of the rear fabric is seen from behind into the knitting data in which the design is seen front ways. Similarly, when the front knitted fabric, (hereinafter front fabric), is to be knitted on the rear bed and the rear fabric on the front bed, the design data of the front fabric must be converted from the data based on seeing front ways to the data based on seeing from behind. Such principles of conversion, however, are not known yet.

Just like the case of shaped knit, it is desirable, in the case of knitting tubular knitted fabrics, to separate the design into the profile of the knitted fabric and resulting bottom rib portions, etc. and other pattern portions. In the case of tubular knitted fabrics, however, no design environment itself has been proposed yet.

In the case of pullovers, one-piece dresses, etc., the knitted fabrics have sleeves. When a sleeve is joined to an armhole of the front body and the back body, the orientation of the sleeve, for example, will be changed, and the respective stitches will be arranged stepwise. As a result, it will become difficult to see the stitches; when the sleeve is in the state of being joined to the armhole, it is difficult to design the sleeve. On the other hand, if the sleeves are displayed separately from the front body and the rear body, the display and the actual design do not correspond well to each other.

It is essential that the design of the front fabric and the design of the rear fabric can be contrasted to each other. This is needed to check the front and rear designs for any contradictions, and to copy a pattern, etc. designed on the front body onto the back body, etc., thus making the design process easier. However, no design environment is known for designing the front and rear fabrics simultaneously.

Connecting the sleeves to the front and back bodies poses some restrictions to the designs of sleeves near the armholes. The joining of sleeves to the bodies, however, is complicated, and it is extremely difficult to design sleeves while considering such restrictions. It should be noted that the present applicant proposed desirable joining conditions of sleeves and bodies (Japanese Provisional Patent HEI 5-51848, corresponding to U.S. Pat. No. 5,289,701).

When the design is completed as described above, it will be necessary to simulate the designed garment. It, however, is difficult to simulate the shapes of the sleeves, in particular, it is difficult to simulate the final shapes of the sleeves after they were joined to the bodies. What is difficult in the simulation of the shapes of the sleeves is to determine the orientation of the sleeves. It is particularly difficult when the sleeves have some raised portions such as darts. When the sleeves are of a simple form such as T-sleeve, the orientation of the sleeves can be predicted, but when the sleeves are of a complex form, it is generally difficult to predict the orientation of the sleeves. To simulate the shapes of sleeves, it has been proposed to compute the tensions exerted in the yarns of the respective portions of the sleeves and determine the shapes of the sleeves from such tensions. The computation of tensions, however, requires much computing.

BRIEF DESCRIPTION OF THE INVENTION

A primary object of the present invention is to achieve that the front fabric and the rear fabric can be designed separately while they are correlated to each other.

A secondary object of the present invention is to achieve that, for example, design data of a rear fabric of a knitted fabric designed by seeing it from behind can be converted into knitting data in which the fabric is seen front ways.

Another secondary object of the present invention is to separate the outline design of a knitted fabric from other designs so as to make the design process easier.

Another secondary object of the present invention is to synthesize and display the design of the front fabric and the design of the rear fabric both designed separately from each other so that the design of the front fabric and the design of the rear fabric can be contrasted and a pattern can be easily copied between the design of the front fabric and the design of the rear fabric.

Another secondary object of the present invention is to achieve that sleeves can be designed without fully knowing the conditions for joining the sleeves to the armholes of the front body and the back body.

Another primary object of the present invention is to simulate the ultimate form of the seamlessly knitted garment after knitting, and in particular, to simulate it without computing the tensions in the yarns.

The method of the present invention for designing a tubular knitted fabric for a flat knitting machine, comprises designing design data of a tubular knitted fabric which comprises at least a front fabric and a rear fabric, storing the design data designed, and displaying the design data designed on a monitor, and is characterized in that design data of the front fabric and design data of the rear fabric are separately stored, displayed and designed.

Preferably, the design data of the front fabric and the design data of the rear fabric both include data on horizontal and vertical positions of stitches, kinds of the stitches including at face and back, and racking directions of the stitches, with respect to one of the design data of the rear fabric and the front fabric, the horizontal positions, face and back, and the directions of racking of the stitches are inverted, and then the design data of the rear fabric and the design data of the front fabric are converted into knitting data. Preferably, the design data of the rear fabric and the design data of the front fabric both include at least two kinds of data, profile data of knitted fabric and pattern data thereof and are stored, displayed and modified independently of each other.

Preferably, the design data include one for the front body, one for the back body and at least one for a sleeve. The designed sleeve, namely the design data of the sleeve, is displayed in parallel with one of the the front body and the back body on the monitor. Further, a start portion of joining between the sleeve and the above one body is also displayed on the monitor. More preferably, a mode for displaying on the monitor the front fabric and the rear fabric in the matched state and a mode of displaying them separately on the monitor are provided. Preferably, whether the sleeve and the front and the back bodies can be joined suitably at joining portions between them is judged according to the number of stitches of the sleeve at the joining portions and to the numbers of stitches of the front and back bodies at the joining portions, and the number of stitches of the sleeve is modified so that the sleeve and the front and back bodies are joined suitably when the joining is judged unsuitable.

The apparatus of the invention for designing a tubular knitted fabric for a flat knitting machine comprises: a frame memory for storing design data of a front fabric of a tubular knitted fabric; a frame memory for storing design data of the rear fabric of the tubular knitted fabric; means for synthesizing the design data of both said frame memories; a monitor for displaying the data of both said frame memories separately, and displaying the data synthesized by said synthesizing means; and means for modifying the design data of the respective frame memories.

Preferably, each of said frame memories are adapted for storing at least two frames of design data comprising profile data and pattern data. Preferably, the design data of the front fabric and the rear fabric both include horizontal and vertical positions of the design, kinds of stitches, racking directions of the stitches, and the following means are further provided: means for inverting the horizontal positions of design, face and back of the stitches, and the racking directions, with respect to one of the frame memories; and means for converting the design data stored in each frame memory into knitting data.

Preferably, the apparatus for designing a tubular knitted fabric for a flat knitting machine further comprises: means for storing joining conditions for a sleeve and front and back bodies of the tubular knitted fabric and for judging whether design data of the sleeve meet the joining conditions according to numbers of stitches, contained in the design data of the sleeve and the front and back bodies at joining portions of the sleeves and the front and back bodies; and means for modifying the design data of the sleeve when they do not meet the joining conditions so that they meet the joining conditions. Preferably, the design data of the sleeve are stored in one of the frame memories in such a way that the sleeve is arranged in parallel with one of the front and back bodies and is joined to said one of the front and back bodies at the joining start portion. Further preferably, the apparatus for designing a tubular knitted fabric for a flat knitting machine further comprises means for synthesizing the design data of the front fabric and the design data of the rear fabric, for displaying the synthesized data, and for making partial copies of data between the design data of the front fabric and the design data of the rear fabric.

The method of the present invention for designing a tubular knitted fabric, having plural elements, to be knitted and to be bound virtually seamless into one garment on a flat knitting machine, while designing and storing design data of the tubular knitted fabric and displaying the data on a monitor, comprises: after designing the design data, converting the design data into knitting data for a flat knitting machine; defining the mutual relationship of loops contained in the design data, according to the knitting data; generating a three dimensional image of the garment to be knitted and bound, and according to the knitting data; and joining the elements according to the knitting data in such a way that shapes of the loops at joining portions between the elements are substantially uniform.

The apparatus of the present invention for designing a tubular knitted fabric having a front fabric, a rear fabric and at least an additional element to be knitted and to be bound into one garment on a flat knitting machine comprising: means for designing said tubular fabric; means for converting the design data into knitting data; means for defining the relationship of respective loops contained in the respective elements according to the knitting data and for generating three dimensional images of the respective elements; transforming means for joining the three dimensional images of the respective elements into an image of the garment and for transforming shapes of the loops in the image of the garment into substantially uniform shapes at joining portions between the three dimensional images of the respective elements; and means for storing the image of the garment.

Preferably, said transforming means comprises: means for substituting the loops with meshes; and means for transforming the meshes according to the knitting data in such a way that the relationship of the loops in the joining portions are maintained and for re-transforming the transformed meshes in such a way that the sizes of the respective meshes are substantially uniform.

In the present invention, the design data of the front fabric of a tubular knitted fabric and the design data of the rear fabric are stored separately from each other. As a result, these design data can be displayed independently of each other, and can be modified independently of each other. For example, the number of courses for the front fabric and that for the rear fabric may be made identical, and for example, the courses of the front body may be allotted to the odd-numbered knitting courses and the courses of the back body may be allotted to the even-numbered knitting courses. With these arrangements, the design data of the front side and the design data of the back side can be designed independently of each other while these design data are kept correlated with each other.

Next, for example, to convert the design data of the rear fabric designed by seeing from behind into knitting data, the horizontal positions of the stitches in the design data of the rear fabric are inverted. Preferably, this inversion is done symmetrically with respect to the center line of the rear fabric in the horizontal direction; it is the mirror inversion. As a result, for example, if there is a pattern of a letter F in the rear fabric, the pattern will be inverted in horizontal direction in the knitting data. Next, the relationship of face/back of the knitted fabric is reversed. For example, a stitch of the rear fabric, which is a face stitch seen from behind, is knitted as a back stitch on the actual knitting machine. This can be solved by making the face/back inversion of the kind of stitch in the design data. Next, the knitting machine racks the needle beds, and the direction of racking is also inverted. As a result of these steps, the design data of the rear fabric designed by seeing it from behind can be converted into the knitting data for the knitting machine. In the description above, the rear fabric is assumed to be allotted to the rear bed. The case wherein the front fabric is allotted to the rear bed can be handled in like manner.

In case of general-purpose knitting machines that knit tubular knitted fabrics as well as other knitted fabrics, it is desirable to make this conversion in the designing apparatus. However, in case of knitting machines dedicated to knitting of tubular knitted fabrics, the designing apparatus may forgo the conversion of the data on the rear fabric, give the data additional information that the data are on the rear fabric and transfer the data to the dedicated machines, and the dedicated machines may use look-up tables, etc. to invert the direction of carriage travel, face/back kind of stitch and the direction of racking in the knitting data of the rear fabric, etc.

With regard to the designs of the front fabric and the rear fabric, preferably, the design data are separated into the profile data of the knitted fabric and the pattern data. As a result, the pattern can be designed independently of the profile, and grading becomes more easier.

Preferably, the designs of sleeves are stored and displayed in such a condition that the sleeves are in parallel with the front body or the back body, the sleeves are being joined with the body at the joining start portions. In this condition, the wale direction and the course direction of the sleeves are parallel to those of the body; hence it is easy to design and the joining start points of the sleeves on the front and back bodies are displayed.

To verify the design data of the front fabric and the rear fabric, it is sufficient to match up these design data and display them. In this way, any discrepancies between the designs can be detected easily. When these designs are matched up and displayed, one can, for example, specify a portion of the front fabric and copy it into the rear fabric. In making synthetic display of the front and rear design data, it is preferable to invert the rear fabric in horizontal direction and give a display that corresponds to the actual positional relationship of the front fabric and the rear fabric.

As the sleeves are joined to the front body and the back body at the armholes, the design of the sleeves is subjected to restrictions. Hence, preferably, the joining conditions for the sleeves and the body are stored, and the number of stitches of the sleeves and the numbers of stitches of the front and back bodies at the joining portions between the sleeves and the front and back bodies are obtained from the design data. These numbers of stitches can be obtained as a matter of course provided the design data are available. Then it is judged whether these numbers of stitches meet the joining conditions for the sleeves and the front and back bodies, and if they do not meet the conditions, the design data of the sleeves will be modified. For example, the number of wales of the sleeve is increased or decreased. Here, preferably, the designing apparatus is made to store several kinds of sleeves such as T-sleeve, set-in sleeve and raglan sleeve, and the designer is asked to specify the kind of sleeve of his or her choice. Preferably, the designing apparatus is made to store the joining conditions between the sleeves and the front and back bodies for each kind of sleeves, and the designer is asked to specify, for the specified kind of sleeves, the dimensions of the front body, the back body and the sleeves. Similarly, the designer is asked to specify the horizontal and vertical sizes of the stitch to be used, and number of stitches of respective portions are determined from the specified dimensions and the specified horizontal and vertical sizes of the stitch. The numbers of stitches thus obtained are compared with the joining conditions between the sleeves and the front and back bodies, and if the joining conditions can not be met, the design data of the sleeves will be modified, for example, the number of wales of the sleeves will be increased or decreased, to meet the joining conditions between the sleeves and the front and back bodies.

In the present invention, the ultimate configuration of the seamlessly knitted garment is simulated from the knitting data. Three dimensional images are used in the simulation. One problem, here, is that one can not predict, for example, when the sleeves are joined to the body, how the loops will be transformed at the joining portions, and as a result, what orientation the sleeves will take. One can see these things only after making actual knitting. Similar problems will be encountered in, for example, joining the collar to the body and joining a pocket to the body. In the present invention, the mutual relationships of the respective loops are defined by the knitting data; the three dimensional image of the seamlessly knitted garment is generated by setting the loops of the following course in the proper relationship to the loops of the preceding loop. The loops are joined at the joining portions according to the knitting data, then the loops after joining are processed to take a substantially uniform shape.

With regard to joining of loops at joining portions, to simplify the process, loops are substituted with, for example, meshes of a rectangle, a triangle, etc. Then, joining is made according to the knitting data by means of, for example, loops that have been substituted by meshes. As a result, for example, the sleeves are hypothetically joined to the body. After this joining, meshes have been transformed extremely due to transfer, etc. used in joining. Then, the transformed meshes will be re-transformed in such a way that the mesh sizes will become substantially uniform. With this re-transformation, the image of the sleeves will change the orientations thereof to those corresponding to the actual garment. Thus the simulation of the configuration of the seamless knitted garment can be accomplished.

In this way, the ultimate form or configuration of the seamlessly knitted garment can be simulated without resorting to computation of tensions in the yarns. The assumption used here is that the loops that have been transformed by joining will go back to a substantially uniform shape when the garment is removed from the needle beds of the flat knitting machine. Using such a reasonable assumption, the present invention can simulate the ultimate form or configuration of the seamlessly knitted garment from the knitting data alone, without resorting to tension simulation.

The present invention is applicable to the simulation of joining a collar or a pocket to the body as well as joining sleeves to the body. Moreover, the present invention can simulate three dimensional forms of sleeves, collar, pocket, etc. with the garments.

BRIEF DESCRIPTION OF THE DRAWINGS

FIG. 5 is a characteristic diagram showing a screen display in the embodiment, wherein FIG. 5(A) shows the front body, FIG. 5(B) a sleeve, and FIG. 5(C) the back body.

FIG. 6 is a characteristic diagram showing a screen display in the embodiment.

FIG. 7 is a characteristic diagram showing a screen display in the embodiment, wherein FIG. 7(A) shows the front fabric, and FIG. 7(B) shows a portion enlarged.

FIG. 9 is a characteristic diagram showing joining of the loop simulation image of the sleeve to the body, wherein FIG. 9(A) shows a sleeve before joined and FIG. 9(B) shows the sleeve joined.

FIG. 10 is a characteristic diagram showing mesh transformation at a joining portion in the embodiment, wherein FIG. 10(A) shows meshes transformed by the joining and FIG. 1O(B) shows re-transformed meshes.

FIG. 11 is a flowchart showing the algorithm of the loop simulation in the embodiment.

EMBODIMENT

Figure 1:
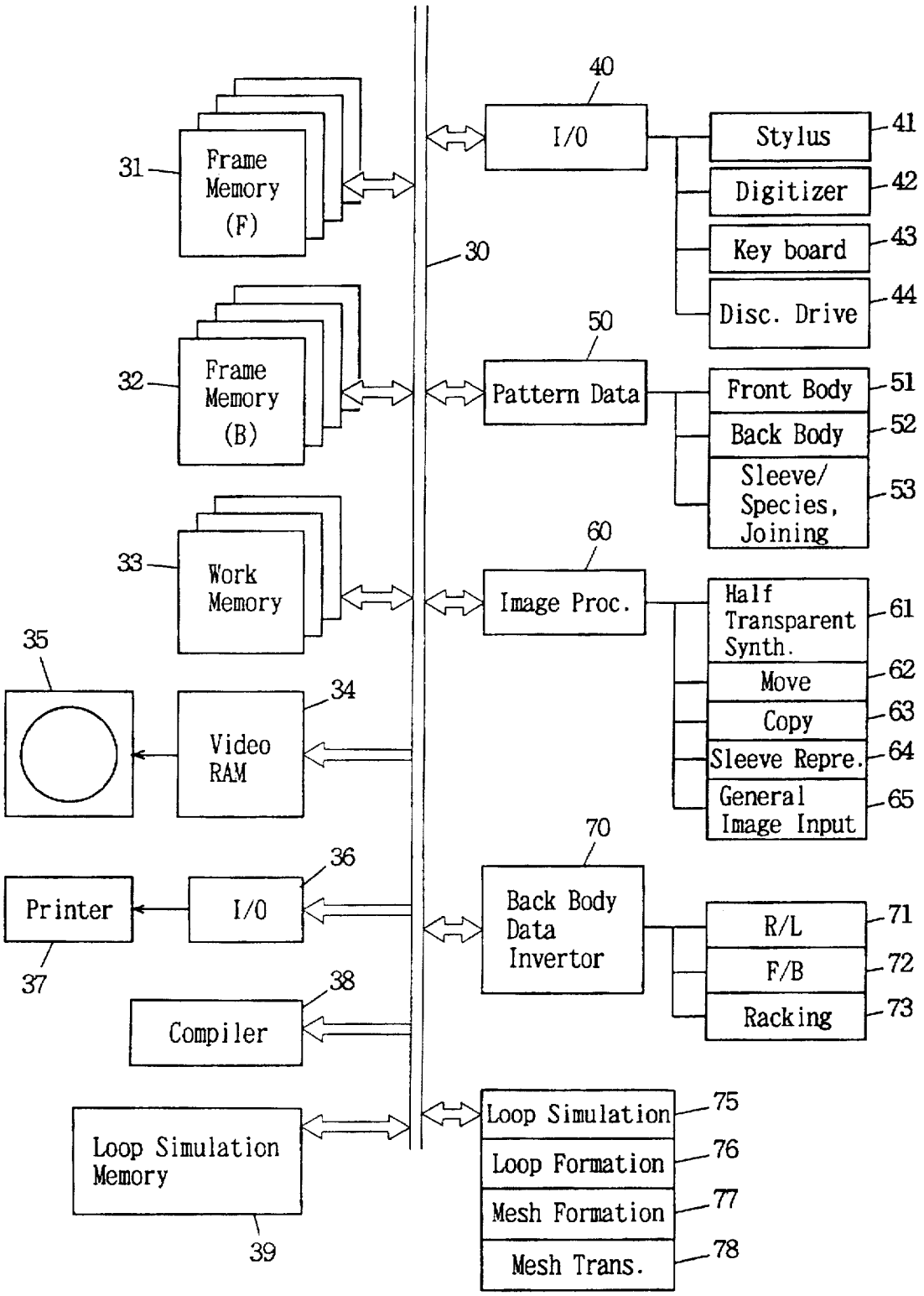
FIG. 1 is a block diagram of the designing apparatus for tubular knitted fabrics of an embodiment.

FIG. 1 shows the configuration of the designing apparatus. 30 is a bus entirely representing the bus for image data and the bus for other instructions, etc. 31 is a frame memory for the front knitted fabric comprising, for example, four frames; a frame for the profile data of the fabric, a frame for the structural pattern, a frame for intarsia and a frame for jacquard. Of these frames, the frame for profile data is made to store the profile of the front fabric, namely, the profile of the front body and the front profiles of the sleeves. Any data that have to be modified in proportion to the profile during grading are stored in the frame for profile data; for example, the positions of rib stitches such as the bottom rib and the cuffs of sleeves, and when a rib structure is provided in the collar, the position of the rib stitches in that part are stored. The frame for structural pattern is made to store the data on structural patterns such as cable pattern. The frame memory 31 is made to store the data so that the sleeves are arranged in parallel with the front body and the sleeves are joined to the front body at the joining start portions. The frame for intarsia is made to store the design data on intarsia patterns, and the frame for jacquard is made to store the design data on jacquard patterns. The configuration itself of the frame memory 31 is widely known because of said Japanese Provisional Patent HEI 7-119004. Any kind of memory element may be used for the frame memory 31. The frame memory 31 is made to store the respective stitches at a size, for example, proportional to the horizontal and vertical aspect ratio thereof, and each frame is provided with a bit length that can store the data to be stored in the frame, such as the kind of stitch, direction of racking and distance.

32 is a frame memory for the rear knitted fabric, and its configuration is similar to that of the frame memory 31 for the front fabric. 33 is a work memory. The intermediate data in the course of computing are stored in the work memory 33. 34 is a video RAM, and 36 is a monitor. The data in the frame memories 31 and 32 can be interpreted as color data, and are displayed on the monitor 35, for example, as color data. It is entirely within the user's discretion whether he or she separates the design data in the color space to display with the color data, namely, the color codes or select another display method. 36 is an I/O device and is used to drive a printer 37 to output the hard copy of the design data. 38 is a compiler and converts the design data into knitting data. The design data at the time of completion of designing are stored in the frame memories 31 and 32, and these data are converted by the compiler 38 into knitting data and fed to the knitting machine.

40 is an I/O device and controls the inputs to the designing apparatus; a stylus 41, a digitizer 42 for inputting the pattern configuration, a key board 43 for inputting numerical data, commands, etc., and a disk drive 44 for inputting the existing design data and inputting and outputting knitting data converted by the compiler 38 are connected to the I/O device 40. 50 is a pattern data generator and includes, for example, a front body data generator 51, a back body data generator 52, and a sleeve data generator 53. The sleeve data generator 53 stores some kinds of sleeves, such as T-sleeve, set-in sleeve and raglan sleeve, and also stores the conditions for joining to the front body and the back body for each kind of sleeves. The sleeve data generator 53 judges whether the profile data of the knitted fabric inputted by the stylus 41, the digitizer 42, the key board 43, etc. meet the joining conditions for the sleeves and the front and back bodies. The numbers of stitches of the front body and the back body and the numbers of stitches of the sleeves near the armholes are used for this purpose. When these numbers of stitches meet the desired binding conditions, the inputted profile data are directly used as the pattern data. When the binding conditions are not met, the design data of the sleeves will be modified. Modification of the design data of the sleeves is made at, for example, the sleeve cap portion. It is effected by increasing or decreasing the number of wales of the sleeves.

60 is an image processing unit and is provided with a half transparent synthesis unit 61 for making half transparent synthesis of the front fabric and the rear fabric and displaying the synthesized image, a move unit 62 for processing movements of patterns in the front fabric, in the rear fabric and between the front and rear fabrics, and a copy unit 63 for processing copies of patterns in the front fabric, in the rear fabric and between the front and rear fabrics. 64 is a sleeve representation unit. The frame memories 31 and 32 store the data of a state wherein the sleeves are arranged in parallel with the front body or the back body, the sleeves being joined to the body at the joining start portions in the lower parts of the armholes. The data stored in the frame memories 31 and 32 are transformed by the sleeve representation unit 64 to generate image data wherein the sleeves are completely joined to the front body and the back body. 65 is a general image input and processes, for example, drawing by the stylus 41 onto the image data stored in the frame memories 31 and 32.

70 is a back body data invertor and processes the image data in the frame memory 32; a right/left invertor 71 inverts the image data with respect to the center line of the back body in the horizontal direction (the center line being in parallel with the height direction), and a face/back invertor 72 inverts the face and the back of stitches in the frame memory 32. Similarly, a racking invertor 73 inverts the racking direction of each stitch in the frame memory 32.

39 is a memory for loop simulation and stores three dimensional images; at the start of the simulation, it stores the images of both the sleeves and the body, and it ultimately stores the image of the seamlessly knitted garment wherein the sleeves are joined to the body and knitting is completed. 75 is a loop simulation processor, 76 is a loop formation unit, 77 is a mesh formation unit, and 78 is a mesh transformation unit. The loop formation unit 76 follows the knitting data given by the compiler 38 and generates three dimensional images of the loops of the sleeves and the body; the mutual relationships of the respective loops are defined by the knitting data, the loops of the following course overlap the loops of the preceding loop, and the relationships of the loops are further determined by the racking, etc. of loops. In this way, the loop formation unit 76 generates three dimensional images of the sleeves, body, collar, pocket, etc. Next, in joining various parts of the seamlessly knitted garment, the mesh formation unit 77 substitutes the respective loops with meshes of, for example, rectangle to simplify the process. The mesh transformation unit 78 joins, for example, the sleeves and the body according to the knitting data. When the sleeves and the body are joined together according to the knitting data, the loops of the joining portions will be transformed extremely. Next, transformation is made again so that the shapes of the respective meshes become substantially uniform. With this process, the sleeves will change their orientations, and the images of the sleeves will correspond to the configurations of the sleeves in the actual seamlessly knitted garment.

The loop simulation processor 75 converts the three dimensional image of the memory 39 into a two dimensional image and displays the converted image on the monitor 35 via the video RAM 34. Moreover, the loop simulator processor 75 restores the respective loops that have been substituted by meshes into the original loop forms so that the final forms can be displayed as loops.

Designing of a Seamlessly Knitted Garment

Figure 2:
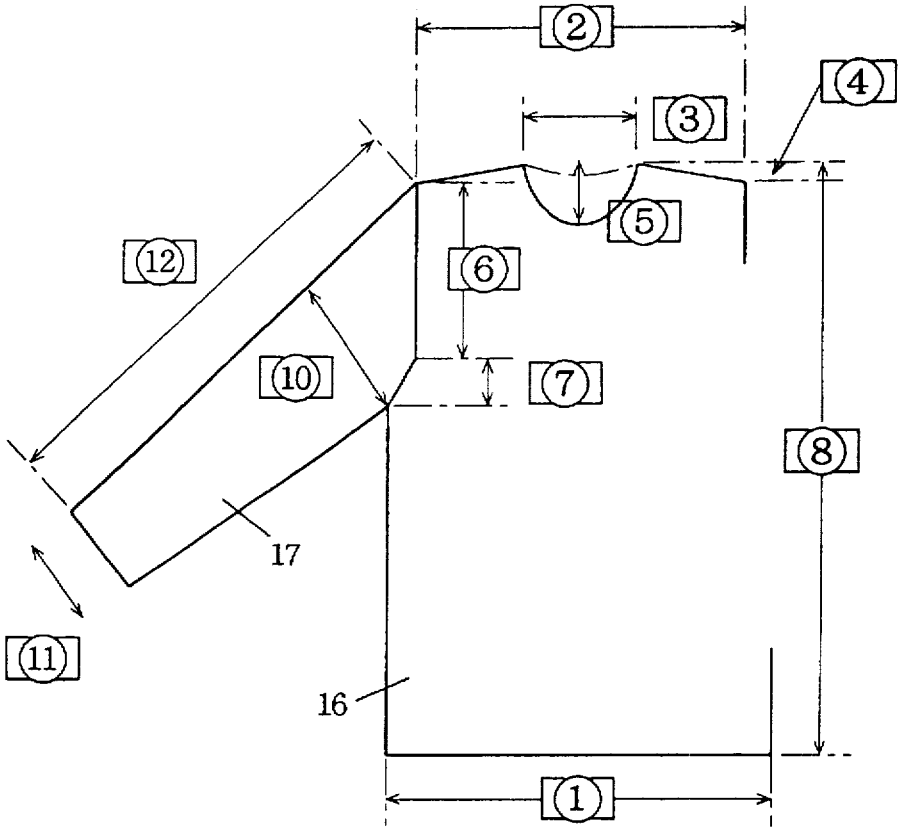
FIG. 2 is a characteristic diagram showing inputs of pattern data in the embodiment.

With reference to FIG. 2 through FIG. 8, the designing process of a tubular knitted fabric will be described. FIG. 2 shows a screen of pattern data input which is the first stage of designing. First, the user is asked to specify the kind of the tubular knitted fabric, such as pullover and one-piece dress. Next, the user is asked to input the kind of sleeves, such as T-sleeve, set-in sleeve and raglan sleeve. Similarly, the user is asked to input the kind of collar such as U-neck and V-neck. Then the screen of FIG. 2 will appear on the monitor 35, and the user is asked to enter the dimensions of 1 through 12 of the diagram through, for example, the key board 43. In place of such inputs, two patterns, one for the front fabric, the other for the rear fabric, prepared in advance may be read by the digitizer 42. These patterns are made by, for example, putting the front portion of the sleeves and the front body together, and putting the rear portion of the sleeves and the back body together. As the right and left sleeves are symmetrical in these knitted fabrics, the sizes of the sleeve may be inputted only for, for example, the right sleeve as shown in FIG. 2. Inputs made in FIG. 2 include the body width 1, the shoulder length 2, the top collar width 3, the shoulder fall 4, front collar fall 5, the vertical height of armhole 6, side recess 7, the total length 8, the sleeve width at the lower end of the armhole 10, the cuff width 11, and the sleeve length 12. The screen that appears next is the screen for inputting dimensions for the rear fabric. The greater part of the data are common to the dimensions for the front fabric, and what differ include the dimension for the back collar fall, etc. although this is not intended to be any limitation. These differences are inputted. When a more complex form of sleeves is inputted, for example, the stylus 41 is used to modify the relevant portions of the outline of the sleeves, and necessary additional dimensional data are inputted. Independently of this process, for example, the key board 43 is used to input the horizontal and vertical sizes of the stitch to be used. With regard to the sizes of the stitch, the sizes of stitch of, for example, plain jersey are inputted. When the sizes of the stitch are applied to the respective inputted dimensions, the numbers of stitches of the respective portions of the knitted fabric will be determined.

Figure 3:
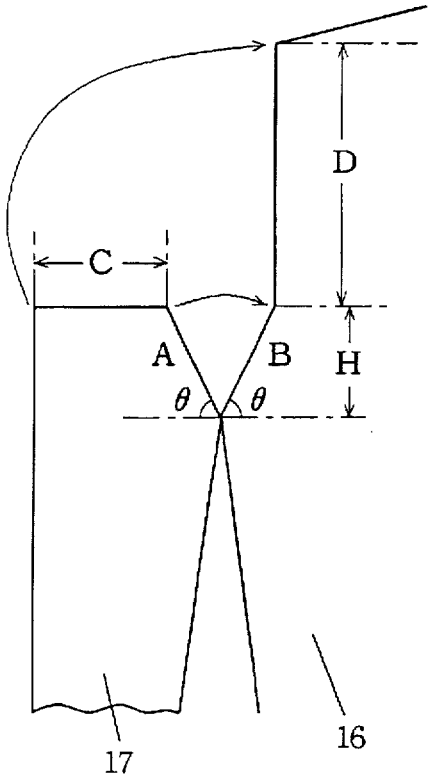
FIG. 3 is a characteristic diagram showing joining of the sleeve to the body in the embodiment.

The numbers of stitches thus determined must meet the joining relationship between the sleeves and the front and back bodies. FIG. 3 shows the case of T-sleeve. The joining conditions in this case are that the part A and the part B have a common height H and form a common angle H with the horizontal line. This means that the part A and the part B of the knitted fabric has the same length. Next, the ratio of the number of stitches of the part C on the sleeve side to the number of stitches of the part D on the body side is set at, for example, 1:2. The body side and the sleeve side are joined along the part A and the part B to knit them into a tubular form, and the part C is transferred to, for example, the part D to join up them.

Figure 4:
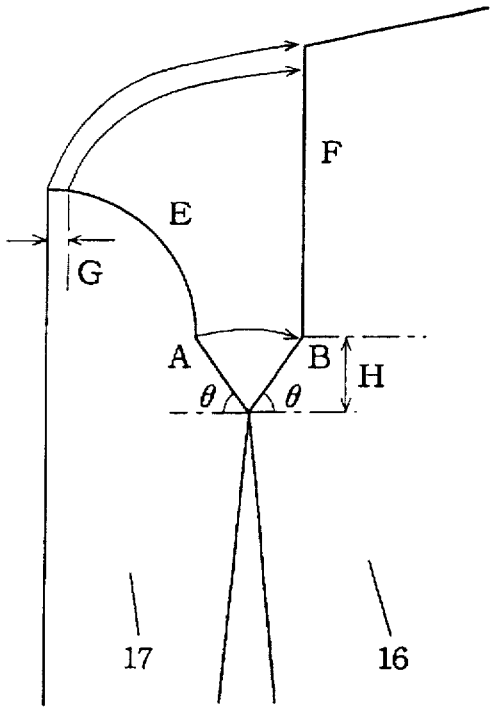
FIG. 4 is a characteristic diagram showing joining of the sleeve to the body in the embodiment.

FIG. 4 shows the case of set-in sleeve. In common with the case of T-sleeve, the part A and the part B have a common height H and form a common angle H with the horizontal line. The ratio of the number of stitches of the part E and the part G of the sleeve 17 to the number of stitches of the part F of the front body 16 is set at, for example, 1:2.

In both cases of FIG. 3 and FIG. 4, the joining conditions for the sleeves and the body must be met. The condition of numbers of stitches for the parts A and B will be met automatically by using the input screen of FIG. 2, and in FIG. 3, if the number of stitches of the part C is not one half (½) of the number of stitches of the part D, the number of wales of the sleeve 17 will be increased or decreased to bring the ratio of the numbers of stitches to ½. Similarly, in FIG. 4, if the number of stitches of the parts E and G is not one half of the number of stitches of the part F, the part G will be increased or decreased by, for example, one wale to bring the ratio of the numbers of stitches to ½. A similar treatment is also made between the rear fabric of the sleeve 17 and the back body 19 shown in FIG. 5.

Figure 5:
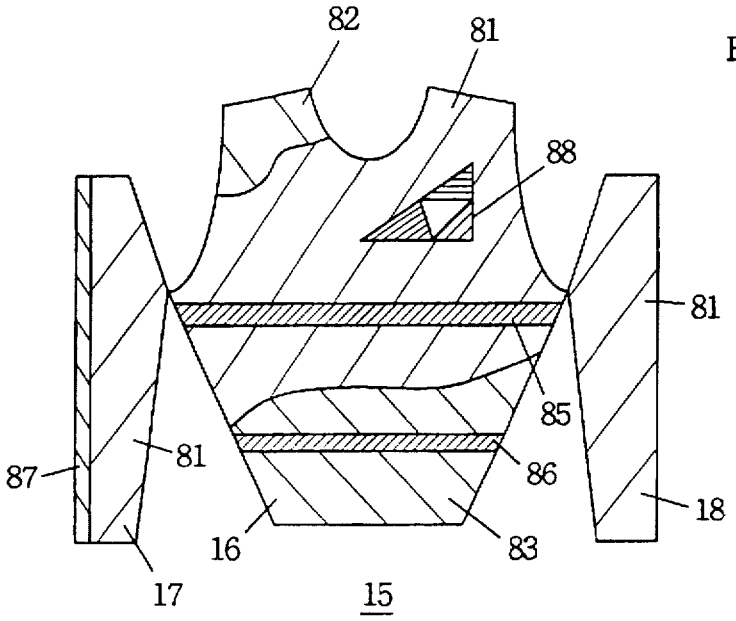
Figure 5:
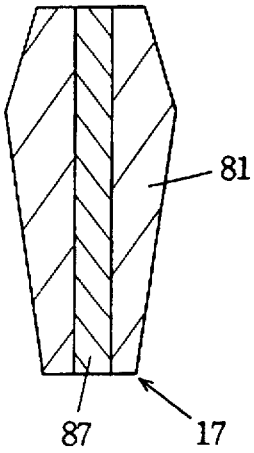
Figure 5:
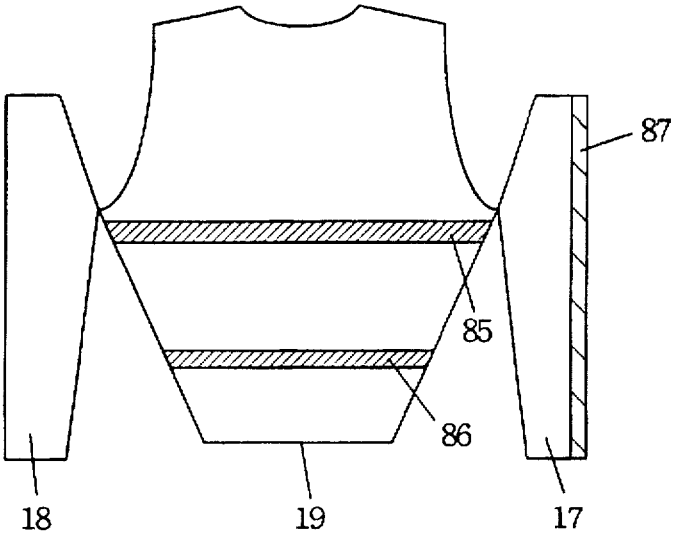

FIG. 5 through FIG. 8 show examples of display of the front fabric and the rear fabric. In FIG. 5(A), is shown an example of display wherein the profile data, structural pattern data, intarsia pattern data and jacquard pattern data are synthesized to show the front fabric. 81, 82 and 83 are intarsia patterns and are stored in the intarsia frame. 85, 86 and 87 are structural patterns and are stored in the structural pattern data frame. 88 is a jacquard pattern and is stored in the jacquard pattern. The relationship of these four frames is, for example, as shown in FIG. 6. The respective frames may be, for example, half-transparently synthesized and displayed, or each frame may be displayed individually. In FIG. 5, the joining start portions of the right sleeve 17, the left sleeve 18 and the half body 16 are displayed, and the sleeves 17 and 18 are displayed in parallel with the front body. In this condition, however, only the front halves of the sleeves 17 and 18 are displayed, and it is hard to grasp, for example, the overall impression of the structural pattern 87. Hence as shown in FIG. 5(B), for the sleeves 17 and 18, the front portion and the back portion of the sleeve can be synthesized and displayed. Selection of these displays is made through a menu, and the processing is done by the sleeve representation unit. With regard to the display of the rear fabric portion of the sleeve 17, the data of the portion are inverted in the horizontal direction and displayed; for example, the left half of the right sleeve 17 in FIG. 5(B) is the back sleeve. Modification of the design data by the stylus 41, etc. can be made, for example, on any screens. In FIG. 5(C), the profile data and the structural pattern data of the rear fabric are synthetically displayed. It is naturally possible, just like the upper half of FIG. 5, to add the intarsia data and the jacquard data to the profile data and the structural pattern data and display them together. The treatment of the front fabric and that of the rear fabric are similar to each other.

FIG. 7 is an example of display showing the right sleeve 17 and the left sleeve 18 are joined to the front body 16. Such a transformation of the display is effected by the sleeve representation unit 64. When the right sleeve 17 is transformed by two dimensional image processing to be joined entirely to the front body 16, for example, the structural pattern 87 will be transformed as shown in FIG. 7(B). Such a display is effective in verifying the joining between the sleeves 17, 18 and the bodies 16, 19, but is not appropriate for designing of the sleeves 17 and 18. Hence designing of the sleeves 17 and 18 is made with a display such as FIG. 5 and FIG. 6 wherein the sleeves and the body are not joined up. The joining display of FIG. 7 is preferably used only to verify the state of joining between sleeves and the body.

Figure 8:
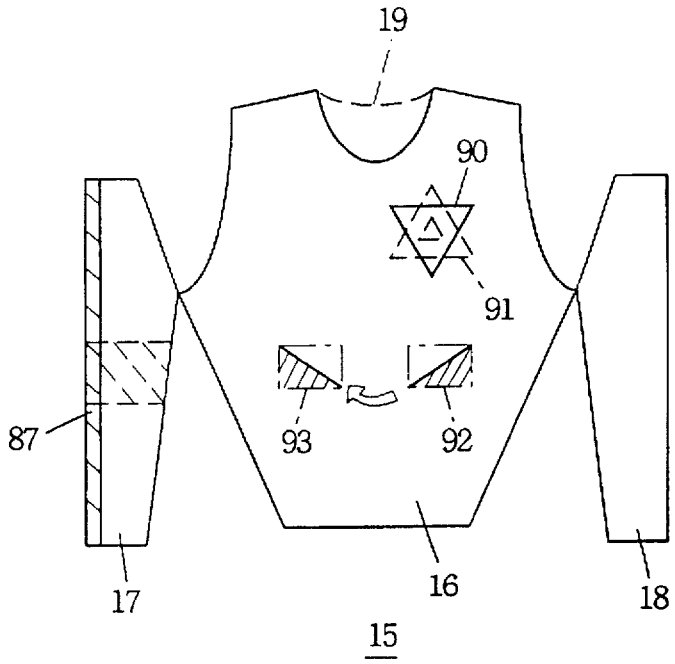
FIG. 8 is a characteristic diagram showing half transparent synthesis and copying between the front body and the back body in the embodiment.

FIG. 8 shows an example of half transparent synthesis display of the front and rear fabrics, and the full line indicates the front fabric and the broken line indicates the rear fabric. In this display, the design data of the rear fabric are inverted in the horizontal direction and displayed, and the front fabric and the rear fabric are displayed by half transparent synthesis. In this way, the positional relationship between the pattern 90 of the front fabric and the pattern 91 of the rear fabric can be checked. Moreover, the patterns such as intarsia and jacquard, the structural patterns, etc. can be moved or copied in the front fabric, in the rear fabric, and between the front fabric and the rear fabric. For example, in the case of FIG. 8, a pattern 92, being the copy source, of the front fabric is copied and used as a copied pattern 93 of the rear fabric.

When the design of the tubular knitted fabric is completed as shown in FIG. 2 through FIG. 8, the design data of the front fabric is stored in the frame memory 31, and the design data of the rear fabric is stored in the frame memory 332. Next, considering the work is a tubular knitting, the respective courses of the front fabric are allotted to, for example, the odd-numbered knitting courses, and the respective courses of the rear fabric are allotted to, for example, the even-numbered knitting courses. It is well known that the data designed by dividing them into four kinds, profile, structural pattern, intarsia and jacquard can be converted into knitting data. Here, with regard to the design data of the rear fabric, the data designed by seeing from behind must be converted. This conversion is effected by the back body data invertor 70. The design image is mirror-inverted in the horizontal direction by the right/left invertor 71, and the face and the back of stitches are inverted by the face/back invertor 72. Similarly, the racking direction of stitches is inverted by the racking invertor 73. For example, if a pattern corresponding to a character F is present in the back knitted fabric, the pattern F will be inverted in horizontal direction by the right/left invertor 71, and the relationship of face stitch and back stitch of plain jersey, rib, cable pattern, etc. is inverted by the face/back invertor 72. The racking direction of rib, cable pattern, etc. is inverted by the racking invertor 73. The inverted data is inputted in, for example, the compiler 38 and converted into knitting data. The converted knitting data is provided via the disk drive 44, in the form, for example, a floppy disk, to a knitting machine to make the actual knitting.

Loop Simulation

Figure 9:
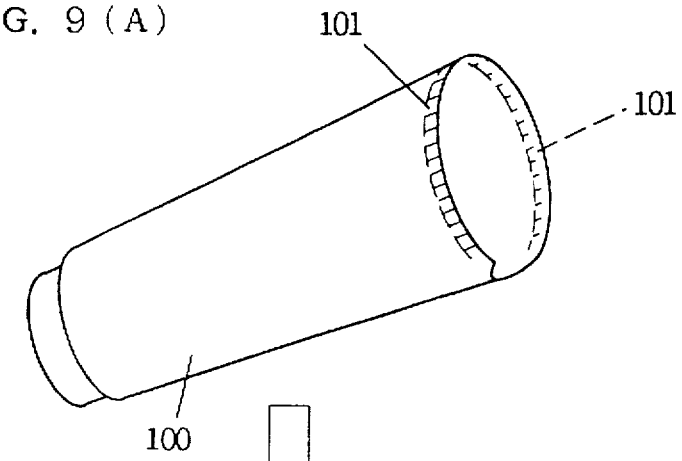
Figure 9:
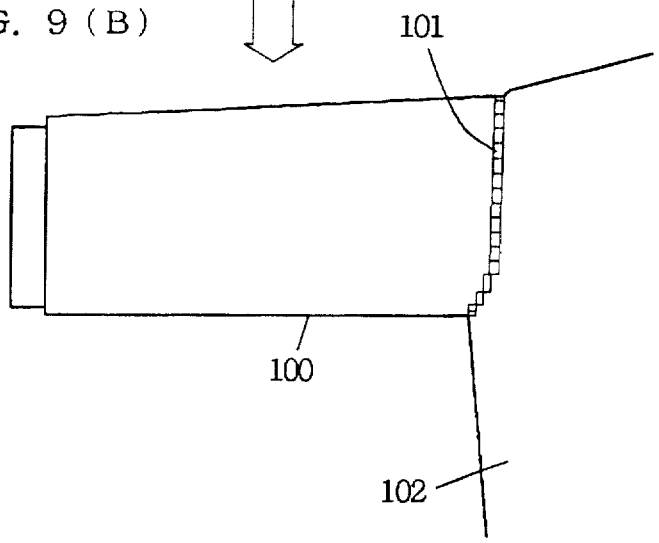

FIG. 9 through FIG. 11 show the process of loop simulation. The compiler 38 reads the data of the frame memories 31 and 32 and converts them into knitting data. According to the knitting data, a loop simulation processor 75 draws the respective loops and makes the memory 39 store a sleeve image 100 and a body image 102. These images are three dimensional and tubular images. In FIG. 9(A), the sleeve image 100 prior to joining to the body is shown schematically. In FIG. 9(B), the body image 102 and the sleeve image 100 after joining are shown. In FIG. 9, the image of loops of the sleeve at the joining portion 101 is shown schematically.

The image of the respective loops are drawn according to the knitting data and by defining the mutual relationships of the loops. The knitting data are used here, and this means that the respective loops are knitted by a hypothetical flat knitting machine in the design apparatus. Generation of a loop image is made by the loop formation unit 76. The sleeve image 100 thus generated is joined to the body image 102. Here, to simplify the process, the respective loops are substituted with rectangular meshes as shown in FIG. 10 by the mesh formation unit 77.

In FIG. 10, 103 is a loop of the sleeve, and 104 and 105 are loops of the body. The sleeve and the body are joined by a loop 101, and as a result, the mesh of the loop 101 will be transformed extremely as shown in FIG. 10(A). However, when the loop 101 is removed from the needle bed, the loop will tend to go back to its original shape due to the tensions in the threads. In this diagram, the horizontal direction of the loop 101 is parallel to that of the loop 103, and the horizontal side of the loop 101 is joined to the loop 104. Hence the mesh transformation unit 78 transforms the loop 101 according to the knitting data, and transforms again the transformed loop back to the original rectangle. When transformed again, the loop 101 will become, for example, as shown in FIG. 10(B). This is continued till the length and the width of the loop come back to substantially constant values. For example, tolerances are set for the length and the width of the loop, and re-transformation is continued till the length and the width settle within their limits. This is to ease the loop transformed by joining towards the original form. When the loop 101 is transformed into the shape shown in the lower part of FIG. 9, the sleeve image 100 will change its orientation to the orientation in the actual seamlessly knitted fabric. As a result, the orientation of the sleeves can be simulated.

In the representation of the simulation image, meshes may be displayed, or the respective meshes may be transformed back to loops of which shapes correspond to the forms of the meshes. In this way, the joining portions, portions with decreased stitch numbers, and portions with increased stitch numbers of the seamlessly knitted fabric can be simulated three dimensionally, thus three dimensional transformations due to the presence of these portions can be simulated in a realistic manner. For instance, when the shape of the sleeve cap is asymmetrical in the front/back direction, and the sleeve cap of the back side of the sleeve is longer, the sleeve will come towards the front, thus their three dimensional volumes can be represented. Furthermore, this is not limited to the simulation of the sleeves. In simulating the collar, pockets, etc., their three dimensional volumes can be simulated in a realistic manner.

Actual Knitting

Figure 12:
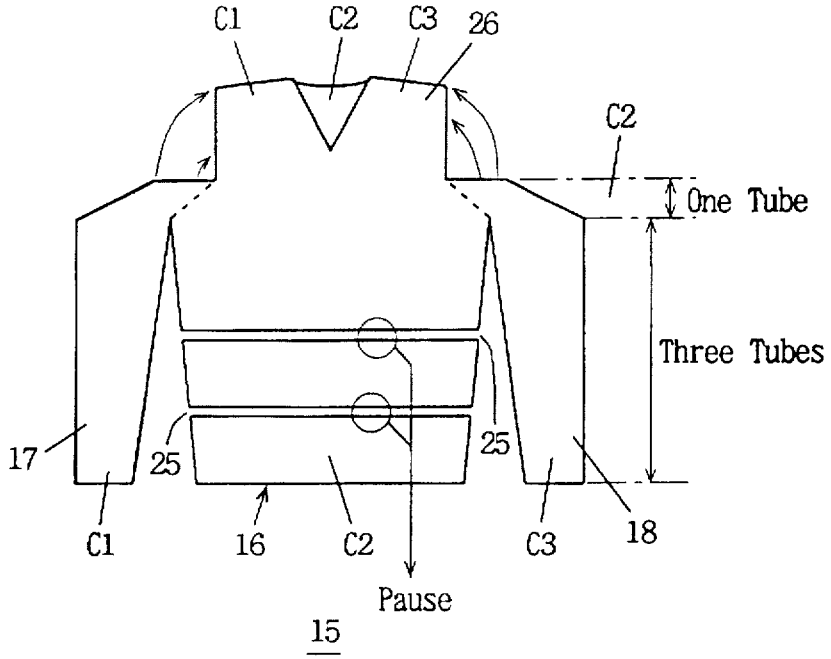
FIG. 12 is a characteristic diagram showing the knitting process of the seamlessly knitted garment in the embodiment.

FIG. 12 shows the knitting process of a garment. For example, to make easier the setting-up on the knitting machine, the cuffs and the bottom of the body are set at the same elevation, and the carriers C1 through C3 are dedicated to the right sleeve 17, the left sleeve 18 and the body, respectively, to form tubular elements. As the lengths of the sleeves 17 and 18 seen from the armholes are normally longer than the relevant length of the body, an appropriate number of courses of knitting halting portions 25 are provided in the knitting course of the body to allow concurrent knitting starting. When the side recess portions at the lower end of the armholes are reached, the use of carriers is limited to, for example, the carrier C2 to knit the sleeves 17 and 18 and the body integrally into a tubular form. After that, for example, the carrier C2 is allotted to knitting of the back body 19, and the carriers C1 and C3 are allotted to knitting of the front body portions right and left to the collar to knit from the armholes up to the shoulders. Stitches of the joining portions of the sleeves 17 and 18 are transferred to the bodies 16 and 19 to join the sleeves 17 and 18 to the front and back bodies. When joining of these parts is completed, the shoulders of the front and back bodies are joined and bound off to complete the seamlessly knitted garment.

I claim:

1. A method of designing a tubular knitted fabric for a flat knitting machine, comprising designing design data of a tubular knitted fabric which comprises at least a front knitted fabric and a rear knitted fabric, storing the design data designed, and displaying the design data designed on a monitor, being characterized in that design data of the front knitted fabric and design data of the rear knitted fabric are separately stored, displayed and designed.

2. A method of designing a tubular knitted fabric using a flat knitting machine of claim 1 being characterized in that the design data of the front knitted fabric and the design data of the rear knitted fabric both include data on horizontal and vertical positions of stitches, kinds of the stitches including at face and back, and racking directions of the stitches, that with respect to one of the design data of the rear knitted fabric and the front knitted fabric, the horizontal positions, face and back, and the directions of racking of the stitches are inverted, and that then the design data of the rear knitted fabric and the design data of the front knitted fabric are converted into knitting data.

3. A method of designing a tubular knitted fabric using a flat knitting machine of claim 1 being characterized in that the design data of the rear knitted fabric and the design data of the front knitted fabric both include at least two kinds of data, profile data of knitted fabric and pattern data thereof and are stored, displayed and modified independently of each other.

4. A method of designing a tubular knitted fabric using a flat knitting machine of claim 2 being characterized in that the design data include the design data of the front body, the design data of the back body and the design data of at least a sleeve, that the sleeve is displayed in parallel with one of the front body and the back body on the monitor with a start portion of joining between the sleeve and said one of the front body and the back body.

5. A method of designing a tubular knitted fabric using a flat knitting machine of claim 1 being characterized in that a mode of displaying on the monitor the front knitted fabric and the rear knitted fabric in the matched state and a mode of displaying them separately on the monitor are provided.

6. A method of designing a tubular knitted fabric using a flat knitting machine of claim 4 being characterized in that whether the sleeve and the front and the back bodies can be joined suitably at joining portions between them, is judged according to the number of stitches of the sleeve at the joining portions and to the numbers of stitches of the front and back bodies at the joining portions and that the number of stitches of the sleeve is modified so that the sleeve and the front and back bodies are joined suitably when the joining is judged unsuitable.

7. An apparatus for designing a tubular knitted fabric using a flat knitting machine comprising:

a frame memory for storing design data of a front knitted fabric of a tubular knitted fabric;

a frame memory for storing design data of the rear knitted fabric of the tubular knitted fabric;

means for synthesizing the design data of both said frame memories;

a monitor for displaying the data of both said frame memories separately, and displaying the data synthesized by said synthesizing means; and means for modifying the design data of the respective frame memories.

8. An apparatus for designing a tubular knitted fabric using a flat knitting machine of claim 7 being characterized in that each of said frame memories are adapted for storing at least two frames of design data comprising profile data and pattern data.

9. An apparatus for designing a tubular knitted fabric using a flat knitting machine of claim 7, wherein the design data of the front knitted fabric and the rear knitted fabric both include horizontal and vertical positions of the design, kinds of stitches, racking directions of the stitches, further comprising:

means for inverting the horizontal positions of design, face and back of the stitches, and the racking directions, with respect to one of the frame memories; and means for converting the design data stored in each frame memory into knitting data.

10. An apparatus for designing a tubular knitted fabric using a flat knitting machine of claim 9 further comprising:

means for storing joining conditions for a sleeve and front and back bodies of the tubular knitted fabric and for judging whether design data of the sleeve meet the joining conditions according to numbers of stitches, contained in the design data of the sleeve and the front and back bodies at joining portions of the sleeves and the front and back bodies; and means for modifying the design data of the sleeve when they do not meet the joining conditions so that they meet the joining conditions.

11. An apparatus for designing a tubular knitted fabric using a flat knitting machine of claim 10 being characterized in that the design data of the sleeve are stored in one of the frame memories in such a way that the sleeve is arranged in parallel with one of the front and back bodies and is joined to said one of the front and back bodies at the joining start portion.

12. An apparatus for designing a tubular knitted fabric using a flat knitting machine of claim 9 further comprising means for synthesizing the design data of the front knitted fabric and the design data of the rear knitted fabric, for displaying the synthesized data, and for making partial copies of data between the design data of the front knitted fabric and the design data of the rear knitted fabric.

13. A method of designing a tubular knitted fabric, having plural elements, to be knitted and to be bound virtually seamless into one garment on a flat knitting machine, while designing and storing design data of the tubular knitted fabric and displaying the data on a monitor, comprising:

after designing the design data, converting the design data into knitting data for a flat knitting machine;

defining the mutual relationship of loops contained in the design data, according to the knitting data;

generating a three dimensional image of the garment to be knitted and bound, and according to the knitting data; and joining the elements according to the knitting data in such a way that shapes of the loops at joining portions between the elements are substantially uniform.

14. An apparatus for designing a tubular knitted fabric having a front knitted fabric, a rear knitted fabric and at least an additional element to be knitted and to be bound into one garment on a flat knitting machine comprising:

means for designing said tubular fabric;

means for converting the design data into knitting data;

means for defining the relationship of respective loops contained in the respective elements according to the knitting data and for generating three dimensional images of the respective elements;

transforming means for joining the three dimensional images of the respective elements into an image of the garment and for transforming shapes of the loops in the image of the garment into substantially uniform shapes at joining portions between the three dimensional images of the respective elements; and means for storing the image of the garment.

15. An apparatus for designing a tubular knitted fabric using a flat knitting machine of claim 14 being characterized in that said transforming means comprises:

means for substituting the loops with meshes; and means for transforming the meshes according to the knitting data in such a way that the relationship of the loops in the joining portions are maintained and for re-transforming the transformed meshes in such a way that the sizes of the respective meshes are substantially uniform.

16. A method of designing a tubular knitted fabric, comprising the steps of designing design data of a tubular knitted fabric which comprises at least a front knitted fabric and a separate rear knitted fabric;

storing the design data designed; and displaying the design data designed on a monitor;

wherein the design data of the front knitted fabric and design data of the rear knitted fabric are separately designed, stored, and displayed.

17. An apparatus for designing a tubular knitted garment using a flat knitting machine comprising:

a first frame memory for storing design data of a front knitted fabric of said tubular knitted garment;

a second frame memory for storing design data of a rear knitted fabric of said tubular knitted garment, wherein said rear knitted fabric is separate from said front knitted fabric;

means for synthesizing the design data of both said frame memories;

a monitor for displaying the data of both said frame memories separately, and displaying the data synthesized by said synthesizing means; and means for modifying the design data of the respective frame memories.

* * * * *